US006299033B1

(12) United States Patent
VerWeyst et al.

(10) Patent No.: US 6,299,033 B1
(45) Date of Patent: Oct. 9, 2001

(54) SNAP-ON CONTAINER CLOSURE WITH HINGED FLAP

(75) Inventors: Gordon E. VerWeyst, Rockford; Alfred I. Gray, Belvidere, both of IL (US)

(73) Assignee: J. L. Clark, Inc., Rockford, IL (US)

( * ) Notice: Subject to any disclaimer, the term of this patent is extended or adjusted under 35 U.S.C. 154(b) by 0 days.

(21) Appl. No.: 09/545,477

(22) Filed: Apr. 7, 2000

(51) Int. Cl.[7] ..... B67D 3/00

(52) U.S. Cl. ..... 222/480; 222/486; 222/546; 222/565; 222/570

(58) Field of Search ..... 222/480, 482, 222/486, 545, 546, 556, 565, 570

(56) References Cited

U.S. PATENT DOCUMENTS

| | | | | |
|---|---|---|---|---|
| 2,975,947 | * | 3/1961 | Pellett | 222/546 |
| 3,322,308 | | 5/1967 | Foster | 222/480 |
| 3,323,671 | | 6/1967 | Minarik, Jr. et al. | 215/40 |
| 3,467,287 | * | 9/1969 | Marchant et al. | 222/480 |
| 3,469,732 | | 9/1969 | Foster | 220/31 |
| 3,675,812 | | 7/1972 | Foster | 220/31 S |
| 4,106,672 | | 8/1978 | Tecco et al. | 222/151 |
| 4,209,100 | | 6/1980 | Uhlig | 215/216 |
| 4,361,250 | | 11/1982 | Foster | 220/266 |
| 4,369,901 | * | 1/1983 | Hidding | 222/480 |
| 4,607,768 | | 8/1986 | Taber et al. | 222/556 |
| 4,621,744 | | 11/1986 | Foster | 220/270 |
| 4,693,399 | | 9/1987 | Hickman et al. | 222/480 |
| 4,807,768 | | 2/1989 | Gach | 215/216 |
| 4,898,292 | | 2/1990 | VerWeyst et al. | 215/237 |
| 5,048,730 | * | 9/1991 | Forsyth et al. | 222/482 |
| 5,509,582 | * | 4/1996 | Robbins, III | 222/480 |
| 5,799,838 | | 9/1998 | Miller | 222/480 |

* cited by examiner

*Primary Examiner*—Joseph A. Kaufman
(74) *Attorney, Agent, or Firm*—Leydig, Voit & Mayer, Ltd.

(57) ABSTRACT

A snap-on closure prevents flaps from coming unsnapped or popping open during assembly of the closure onto the neck of a container. The snap-on connection between the container and the closure includes a circular groove and a circular rib projecting into the groove. The closure includes dispensing ports such as sifter holes, a pouring hole, and/or a spooning hole which are closed by hinged flaps which snap-on the horizontal platform of the closure. The flaps may include plugs which project into their respective dispensing openings and provide a seal against the wall of the opening. The closure also includes a resilient crush seal which engages the neck of the container to provide a seal between the closure and the container.

28 Claims, 8 Drawing Sheets

SNAP-ON CONTAINER CLOSURE WITH HINGED FLAP

FIELD OF THE INVENTION

This invention relates to server lids or closures for containers, more particularly, to injection molded plastic closures with hinged reclosable flaps enabling the contents of the container to be dispensed through the closure.

BACKGROUND OF THE INVENTION

One conventional form of product dispenser for spices, condiments and other similar dry particulate materials includes a container with a round server lid screwed onto its neck. The round server lid is often known and referred to as a "closure" by those skilled in the art. In the product dispensing art, round closures include one or more dispensing ports for such purposes as sifting, pouring or spooning spices or other condiments from the container. These closures also include one or more vertically movable flaps that snap close over the dispensing ports to keep the product in the container. In this particular server lid closure art it is conventional that the round closure is screwed onto the neck of a container. One reason for this convention is that a separate plastic or foil seal strip is often applied over the entire open end of the container. The plastic or foil seal strip serves the purpose of maintaining the freshness or shelf-life of the product inside the container. Prior to first use, the closure is removed by unscrewing it, the plastic or foil seal strip is removed, then the closure replaced. An exemplary product dispenser including a closure as described above is generally disclosed in VerWeyst et al., U.S. Pat. No. 4,898,292, the disclosure of which is hereby incorporated by reference in its entirety.

Round closures as disclosed in the '292 patent to VerWeyst et al. work very well and are highly practical for the consuming public. However, as is recognized by the '292 patent to VerWeyst et al., round screw-on closures present certain difficulties from an automated assembly standpoint. In particular, when the closure is screwed on the container, the resilient plastic material in the closure tends to deflect or shift after the closure engages the top lip of the container towards the end of the screwing motion. Occasionally too much torque is applied (a condition known as over-torquing) which results in the hinged flaps undesirably popping open. The '292 patent to VerWeyst et al. discloses an improved locking arrangement to address this problem and better maintain the hinged flaps in the closed position during assembly. Although the locking arrangement taught by VerWeyst et al. reduces the number of open flaps occurring during assembly, an undesirable number of flaps still inevitably open during assembly operations even with this improvement. This specific locking arrangement also reduces the number of design options possible for the port configuration of the dispensing ports of the closure.

SUMMARY OF THE INVENTION

It is the general objective of the present invention provide a round closure having hinged flaps for closing dispensing ports in which the flaps more reliably stay closed during assembly operations of the closure to a container.

While achieving this above objective, it is another objective of the present invention to maintain the desired freshness of product inside the container for certain applications.

In accordance with these and other objectives, the present invention is directed towards a novel snap-on closure having hinged flaps, in which the closure is adapted to be snapped on the cylindrical neck of a container during assembly. The closure includes a cylindrical skirt depending vertically downward from a generally horizontal platform. The platform includes at least one dispensing port such as a spoon hole, a pour hole, and/or sift holes. For each dispensing port, a hinged flap is provided that swings between open and closed positions to correspondingly open and close its dispensing port. The cylindrical skirt and the cylindrical neck of the container include cooperating interfitting locking structures which snap together to lock the closure on the container in a substantially non-removable manner. In a preferred embodiment these structures comprise an interlocking projection and recess structure, both of which follow a circular and non-helical path. It is an important advantage that the closure is installed by being pressed into place and without the need for torque, thereby reducing the number of flaps that pop open or otherwise come unsnapped during assembly due to shifts or deflection in the resilient plastic material of the closure. The present invention is also directed towards the combination of the snap-on closure and the container.

It is an aspect of the present invention that the flaps include plugs that fill their dispensing ports and provide a seal against the walls of the dispensing ports. It is another aspect of the present invention that a crush seal is provided between the closure and the neck of the container. It is an advantage that these seals maintain freshness of product in the container by minimizing air transfer between the inside of the container and the external environment. With these seals, a plastic or foil sealing strip over the open end of the container is not necessary for most applications. As such, the snap-on connection can be substantially permanent meaning that the closure is not intended to be removed by the customer.

Other object and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
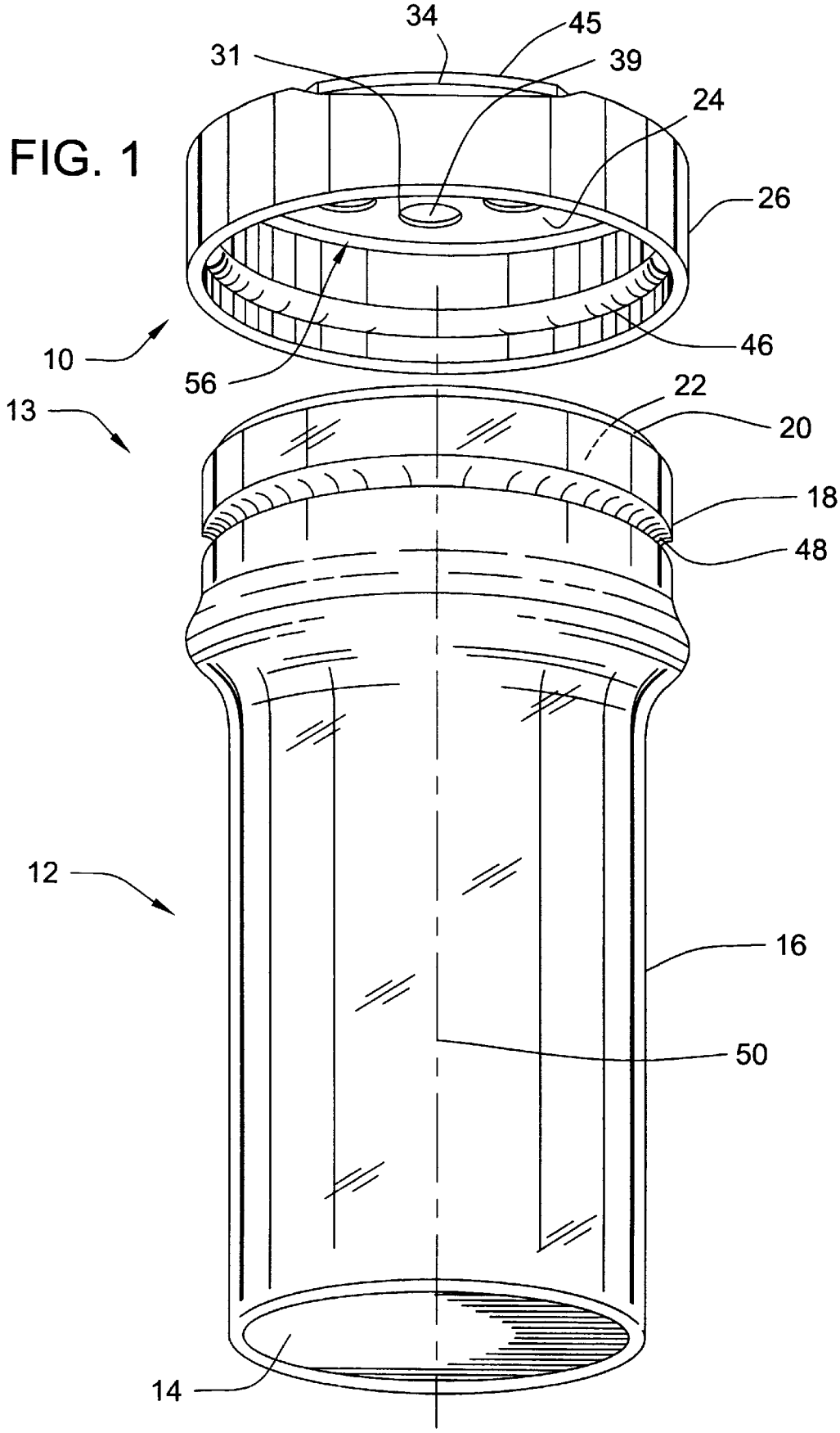
FIG. 1 is a perspective view of an unassembled dispenser including a snap-on closure and a container, in accordance with a preferred embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

For purposes of illustration, the invention has been shown in the drawings as embodied in a one-piece server lid or closure 10 for closing the open end of a container 12 which herein is a glass or plastic jar. The combination of the closure and the container provides a product dispenser 13. The container 12 includes a closed end 14 and a vertically upwardly extending wall 16 to define an internal volume for containing such products as spice, condiments or other relatively dry flowable particulate products. The container 12 also includes a cylindrical neck section 18 having an upper rim 20 that defines a circular opening 22. Although a cylindrical container is shown, it will be appreciated that the closure 12 of the present invention can be used with other shapes of containers that are formed with cylindrical necks to include rectangular box-like containers.

The closure 10 is molded of resiliently yieldable plastic material such as polypropylene and comprises a round generally horizontal platform 24 and a downwardly depending cylindrical skirt 26. The cylindrical skirt 26 has an inner diameter that is closely dimensioned to the outer diameter of the cylindrical neck 18 such no substantial gap is formed between the skirt and the neck. The inner cylindrical surface of the skirt 26 may actually be in direct contact with the outer cylindrical surface of the neck 18. Recessed surfaces 28, 29 are located on opposite sides of the platform 24 with a raised plateau portion 37 therebetween. Each recessed surface 28, 29 typically includes a dispensing port. For example, in this embodiment, a large pour hole 30 is formed through one side of the platform 24 and a plurality of smaller sifter holes 31 are formed through the other side of the platform 24. The pour hole 30 and sifter holes 31 are adapted to be separately closed by similarly formed flaps 34, 35, respectively, located on opposite sides of the platform 24. Each flap 34, 35 is substantially semicircular in shape similar to the shape of its respective recessed surface 28, 29 and is integrally connected to the platform 24 by a hinge 36 provided by a thin web of plastic material formed on the intermediate raised plateau portion 37 of the platform 24. By virtue of the hinge 36, the flaps 34, 35 may be swung upwardly and downwardly between open and closed positions as illustrated by a comparison of FIGS. 2–3 and 4–5. The illustrated form of flaps and sectional plateau is preferred for many spice bottle applications, but other flap and port arrangements can also be used.

In the preferred embodiment, the flaps 34, 35 include generally flat sides. However, plugs 38, 39 may project from the bottom surface of the flaps 34, 35. The plugs 38, 39 are aligned with and are sized closely to the shape or diameter of their respective dispensing holes 30, 31. In the closed position, each plug 34, 35 substantially fills its respective dispensing hole 30, 31 and preferably forms a close fit or an interference fit with the wall of its dispensing hole to form a seal. Seals provided between the plugs and the platform prolong the shelf-life and maintain freshness of the contents inside the container. In the preferred embodiment, these seals are accomplished by increased diameter or outwardly projecting ribs 40, 41 that completely surround each plug 38, 39. Each outward projecting rib 40, 41 engages either the bottom surface of the platform 24 or alternatively the sidewall of its respective dispensing hole 30, 31 to provide a seal. In either event, the size and shape of the ribs 40, 41 is dimensioned and shaped such that the seal is generally continuous around each of the plugs. The outwardly projecting ribs 40, 41 by their shape and dimension provide a snap fit connection which cooperate with corresponding nibs or catches 42, 43 formed into the platform 25. In this embodiment, the corresponding snapping nibs or catches 42, 43 are provided by either a closely dimensioned sidewall of the dispensing port to provide a resistance fit or alternatively the bottom surface of the platform 24 to catch the corresponding ribs 40 or other snapping nibs formed on the plugs 34, 35. The outward projecting ribs 40, 41 and the catches 42, 43 provide cooperating snap connectors that are adapted to releasably snap together to hold the flaps in the closed position. Each flap also preferably includes a lift tab 45 that is positioned over a recess 47 at the outer peripheral corner between the skirt 26 and the platform 24. The lift tab 45 provides a structure which is easily engaged by the finger of a person to facilitate easier opening of the flaps.

Figure 14:
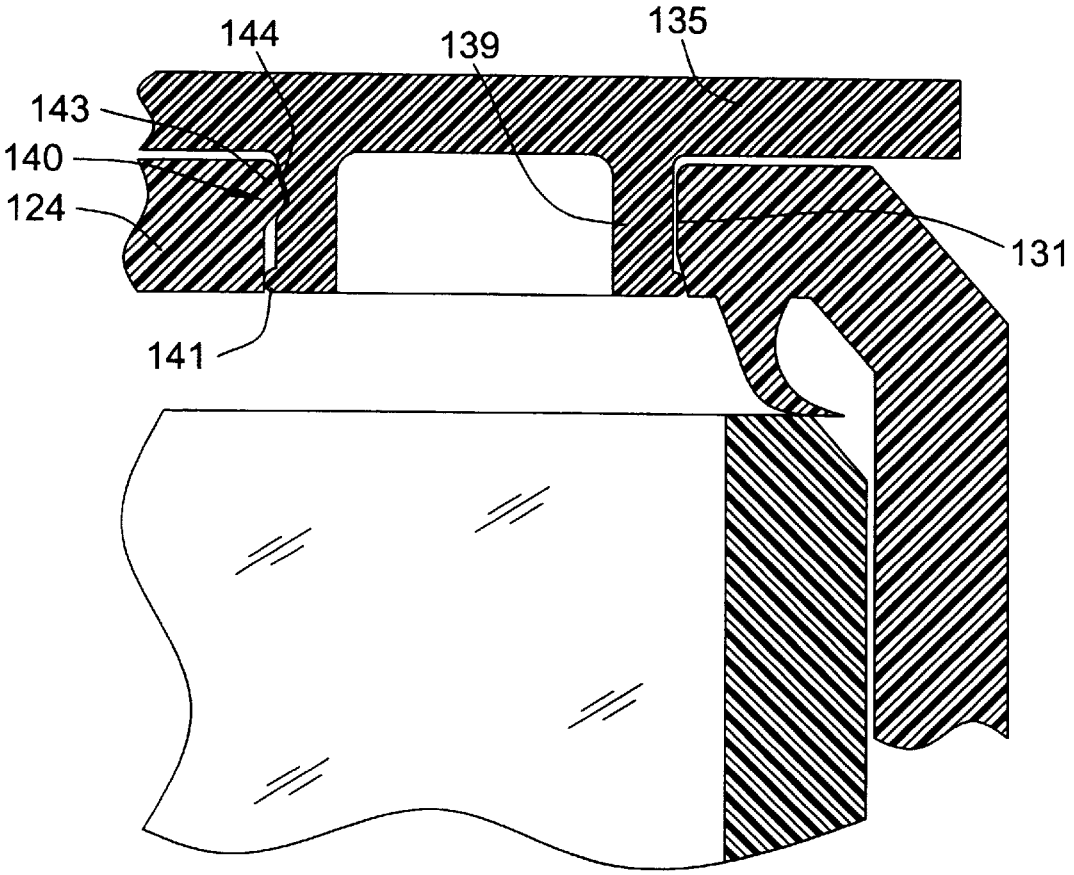
FIG. 14 is a fragmentary cross-section of an alternative embodiment of the present invention demonstrating that other forms of plugs and snapping nibs for the hinged flap can also be utilized.

While a preferred form of plugs have been shown in the preferred embodiment and described above, it will also be appreciated that other forms of plugs can be used with alternative forms of releasable snapping arrangements. For example FIG. 14 illustrates an alternative embodiment in which a differently shaped sifter plug 139 projects downward from a hinged flap 135 into a sifter hole 131 in a closure platform 124. The sifter plug 139 includes a releasable snapping structure 140 near the top that is separate from the circular sealing rib 141 near the bottom. In this embodiment the snapping structure 140 comprises a recess 144 in the plug that is received into a snapping nib projection 143 formed into the platform 124. The sifter plug 139 may also include a sealing rib 141 that contacts the surrounding wall of the sifter hole 131 to provide a seal.

It will be appreciated that the size of the sifter holes 32 is dependent upon the desired application in that the size of the sifter holes 32 are formed just larger than the size of spice or other particulate material in the container 12. It will also be appreciated that the type, size, number and shape of the dispensing ports can be varied as desired to meet the requirements of the application. In addition, although two forms of snap fit connectors are disclosed in the present application, it will be appreciated that other connector configuration can be used to hold the flaps in the closed position. Other arrangements of flaps/dispensing holes and other forms of releasable snap connectors can also be used such as those forms for example disclosed in U.S. Pat. Nos. 4,898,292 to VerWeyst et al., U.S. Pat. No. 4,361,250 to Foster, U.S. Pat. No. 4,693,399 to Hickman et al., U.S. Pat. No. 5,799,838 to Miller, and U.S. Pat. No. 3,323,671 to Minarik Jr. et al., the disclosures of which are incorporated by reference for these above purposes. As generally demonstrated by these patents, the snap fit connectors can be located virtually anywhere such as on the outer semicircular edge of the flaps which interact with a raised projection on the platform of the closure, or for example on a tab projecting from the semicircular edge of the flap.

Figure 2:
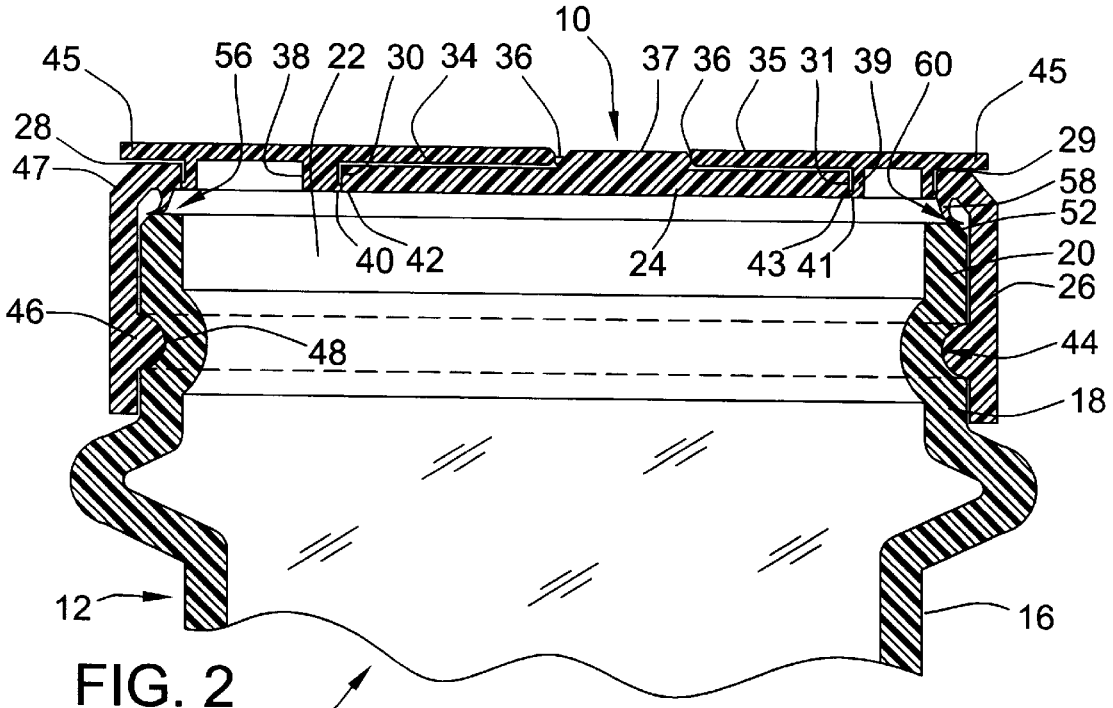
FIG. 2 is a top fragmentary cross sectional view of a dispenser assembled from the pieces shown in FIG. 1, including the closure snapped on the container with the flaps illustrated in the closed position.
Figure 3:
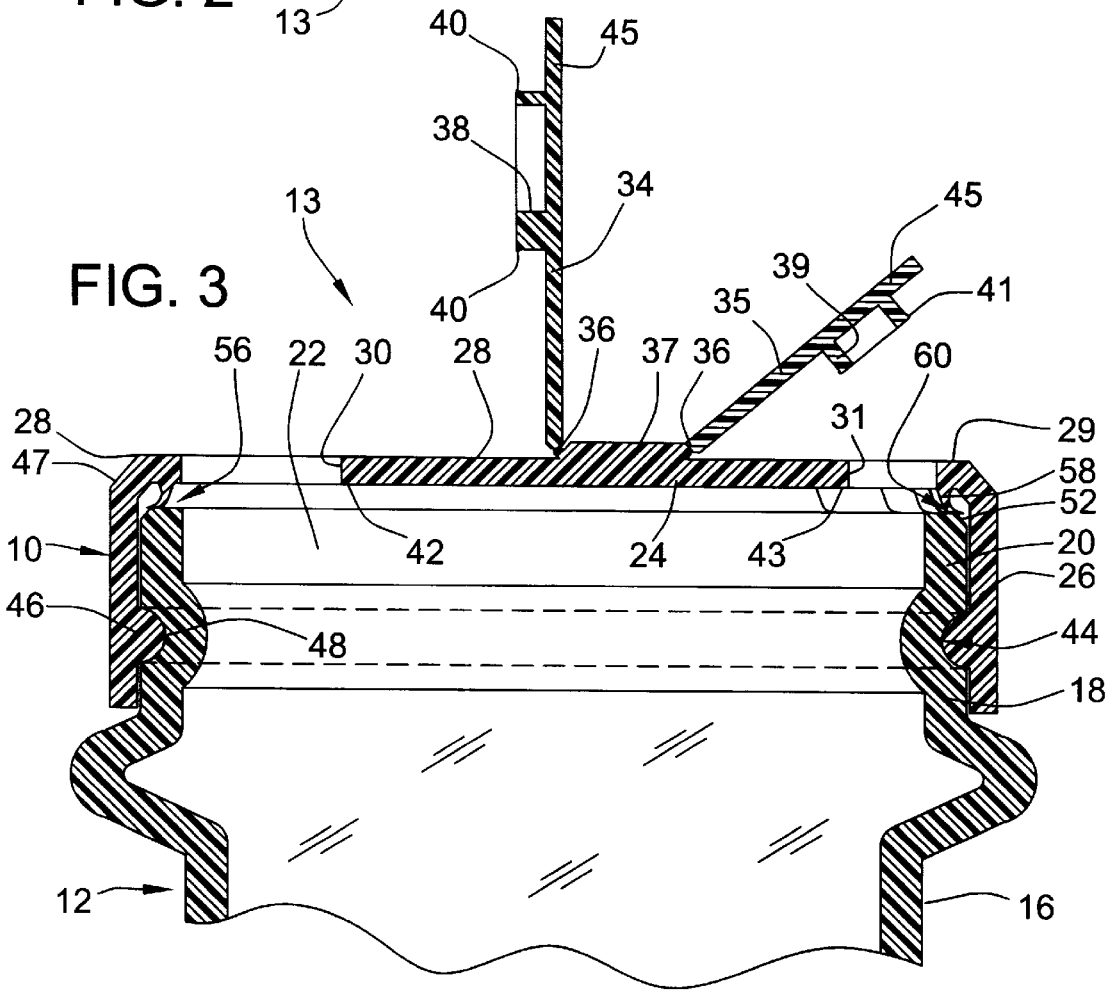
FIG. 3 is the same view as FIG. 2, but with the flaps illustrated in the open position.
Figure 4:
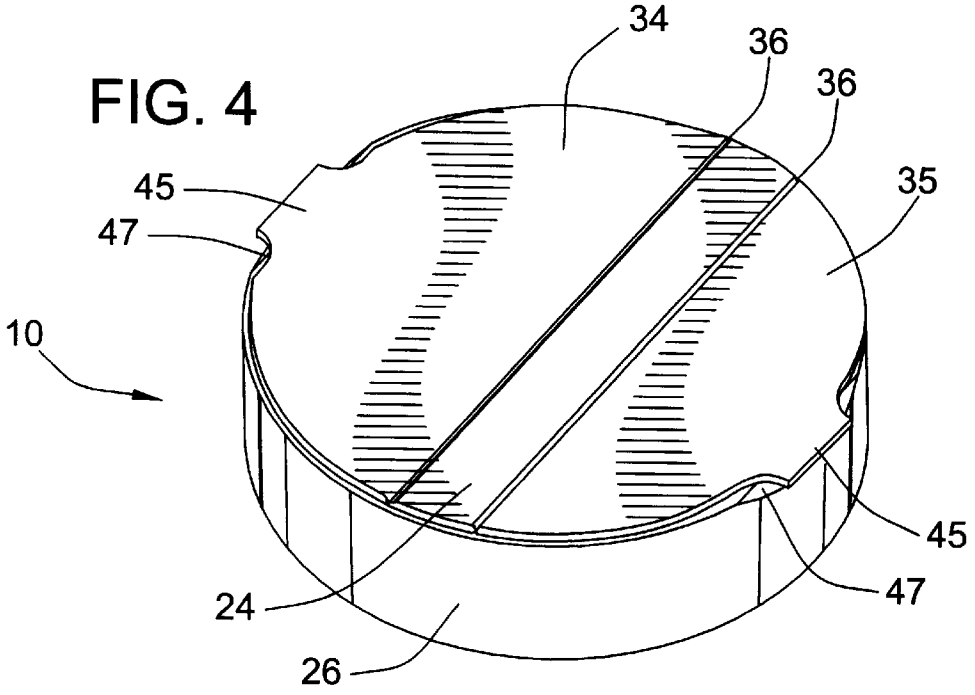
FIG. 4 is a top perspective view of the closure shown in the previous figures with the flaps illustrated in the closed position.
Figure 5:
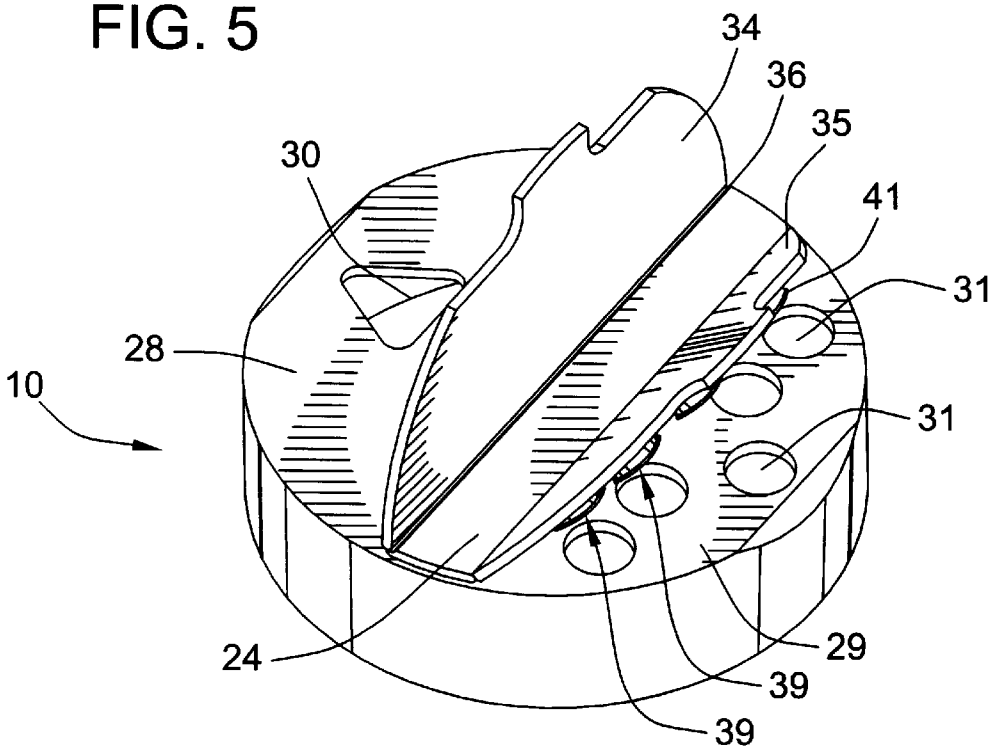
FIG. 5 is the same view as FIG. 4 but with the flaps illustrated in the open position.
Figure 6:
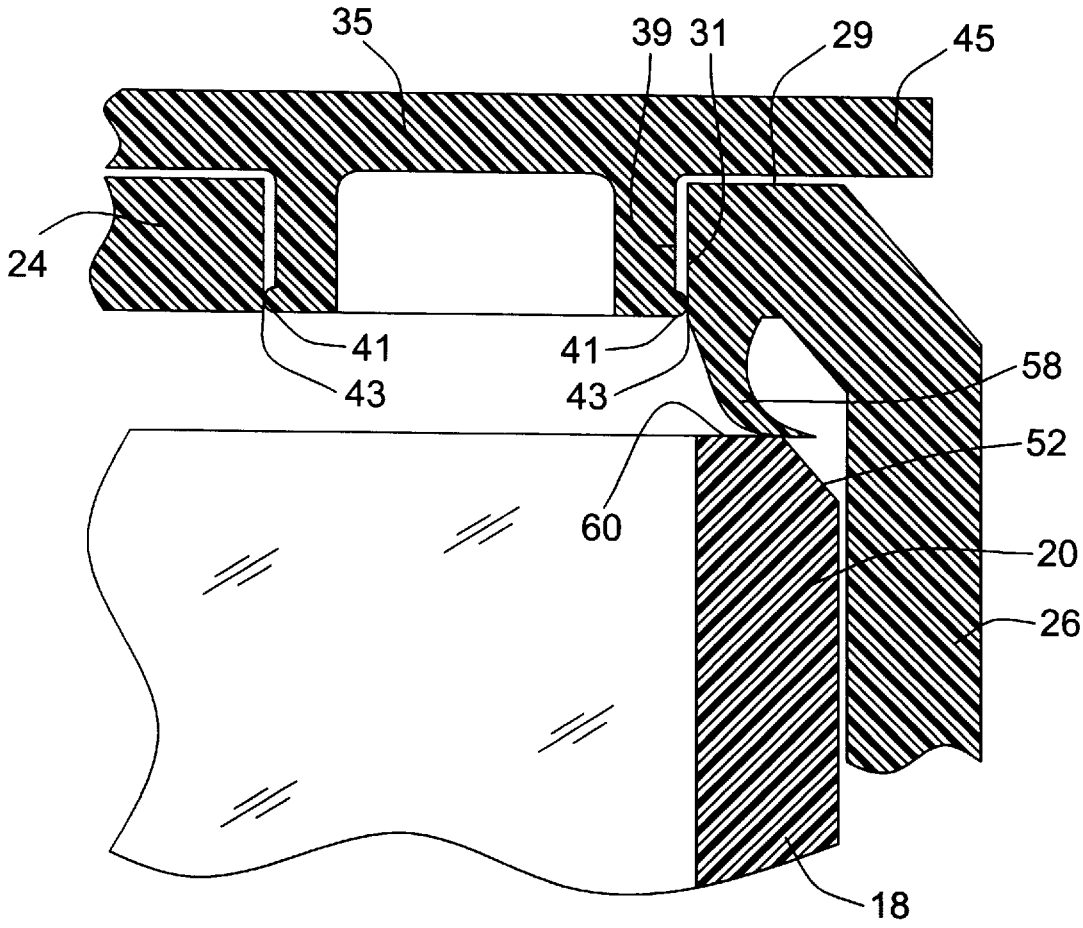
FIG. 6 is an enlarged fragmentary cross sectional view of a portion of FIG. 3.

In accordance with the present invention, a non-threaded snap-on connection is provided for retaining the closure 10 on the container 12. The snap-on connection includes an interfitting projection and recess structure on the container and the closure which locks the closure on the container in a substantially non-removable condition. Non-removable in this context is meant that the closure is not intended to be removed in normal use, and in fact cannot be removed by normal manual manipulation such as would be applied to a screw type closure. In the present embodiment, the interlocking projection and recess structure takes the form of a radially inward projecting circular projection or rib 46 on the skirt 26 and a circular receiving recess or groove 48 on the neck 18 of the container. The rib 46 has an inner diameter that is smaller than the outer cylindrical diameter of the neck 18 or sealing lip 20. More specifically, the inner diameter and shape of the rib 46 is sized closely to the shape and inner diameter of the groove 48. As illustrated in FIG. 2, the rib 46 projects into the groove 48 to engage either the side walls of the groove or alternatively the groove bottom and as such, the circular rib 46 has an inner diameter sized closely to the diameter of the bottom of groove 48. The rib 46 engages the top wall of the groove 48 for vertical retention of the closure 10 on the container 12. In the preferred embodiment, the rib 46 and the groove 48 both follow a non-helical and continuous path as illustrated and both have a semicircular cross-section as seen in FIGS. 2 and 3. The intermitting projection and recess structure is engaged as the closure is pressed over the neck, of course after filling the container. No freshness seal is applied, because the closure, once fitted, is not intended to be removable. During assembly, pressure of the closure onto the neck causes the outside of the skirt to flare radially outward as the rib 46 rise against the outer wall of the closure cylindrical top. Ultimately a position is reached in which the rib 46 is trapped in the groove 48, forming a projection and recess lock which is only removable by the application of substantial force preferably with the use of a tool. For practical purposes the closure is non-removably locked on the container. And it is done by simple mechanical pressing equipment without the need for torque, thereby eliminating the over-torquing lid-popping problem.

Figure 9:
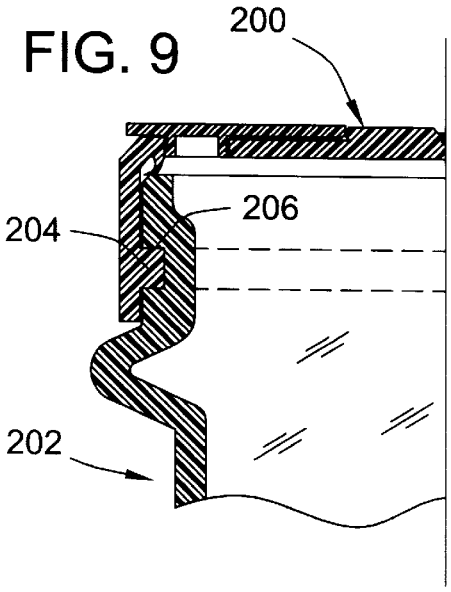
FIGS. 9–13 are fragmentary cross-sections of five alternative embodiments of the present invention demonstrating additional different interfitting snap-on connections that can be utilized.
Figure 11:
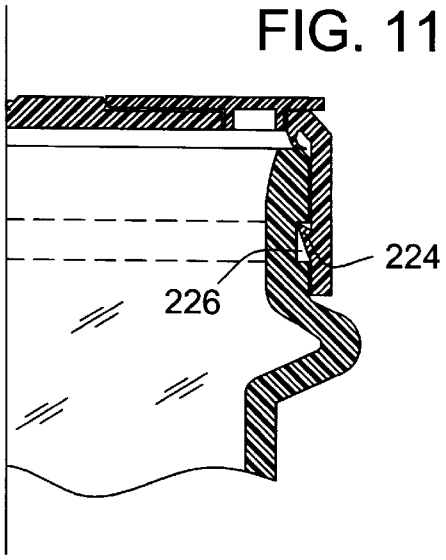
Figure 10:
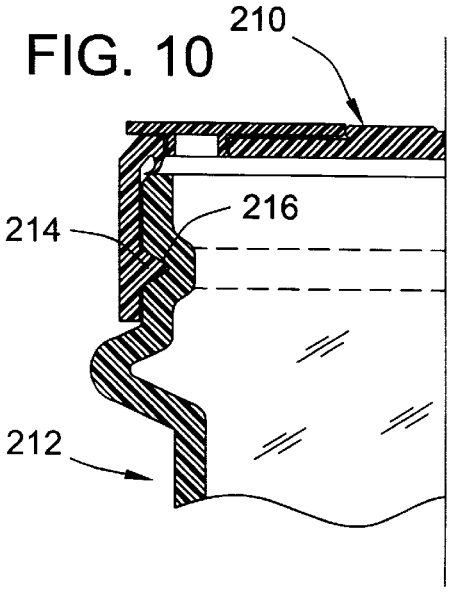

It will also be appreciated that other projection and recess configurations could be provided other than a U-shaped or hemispherical shape as shown. For example, non-continuous configurations could also be provided in which the rib 46 is broken up into projecting tabs or gripping teeth and the groove 48 is broken up into individual receiving channels or slots. FIGS. 9–13 disclose alternative embodiments of the invention. From these alternative embodiments, it will also be appreciated that the interfitting recess structure and the projection can take other shapes. For example, FIG. 9 illustrates a snap fitted and interlocked closure 200 and container 202 that includes a square cross-sectional configuration of a rib 204 and a groove 206 providing the snap fit connection. FIG. 10 illustrates a snap fitted and interlocked closure 210 and container 212 with a V-shaped cross-sectional configuration of a rib 214 and a groove 216 also providing a snap fit connection. FIG. 11 illustrates a configuration that is somewhat of a collaboration of that shown in FIGS. 9 and 10, but with the rib 224 angling upwardly interfitting with a larger square shaped groove 226, such that removal of the lid is even more difficult.

Figure 7:
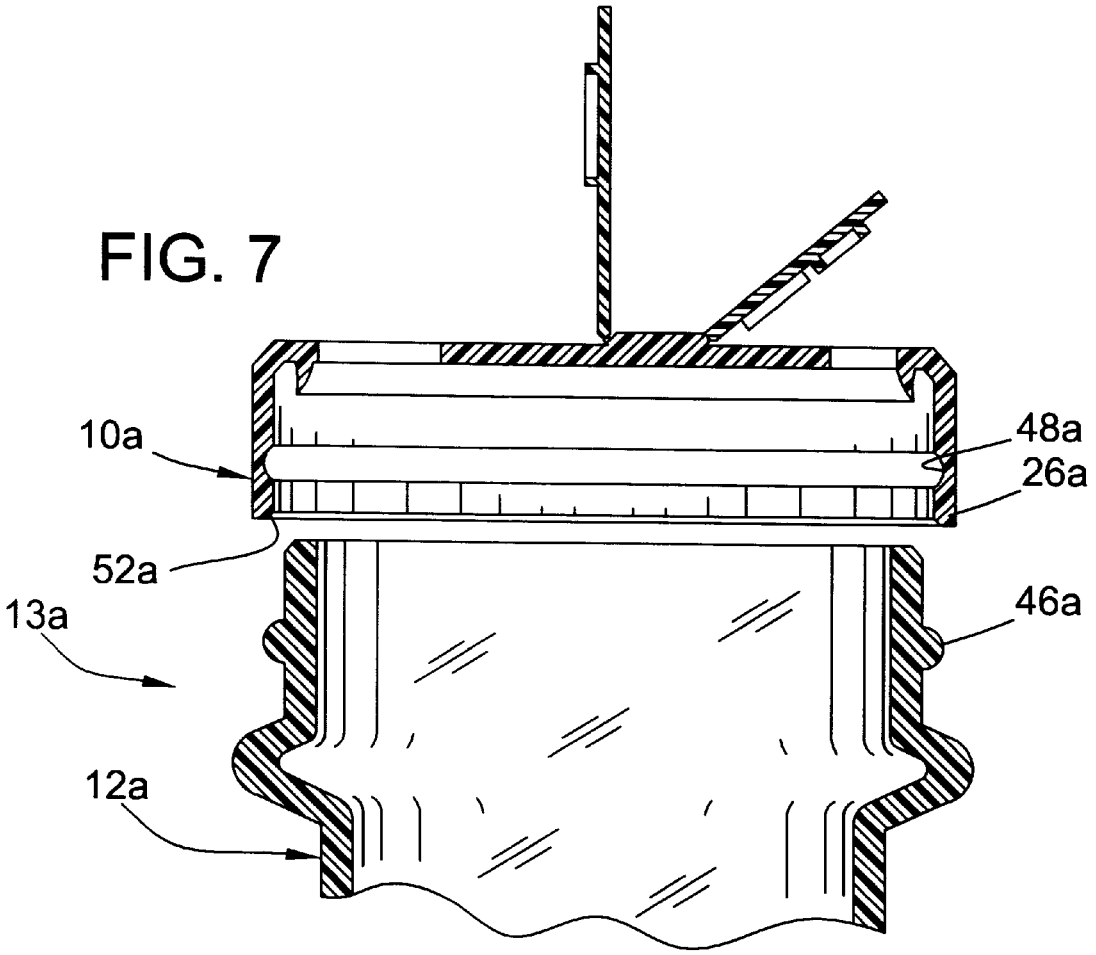
FIG. 7 is fragmentary cross sectional an alternative embodiment of the present invention.

A further alternative embodiment of the snap-on connection for a dispensing container 13*a* is illustrated in FIG. 7. As shown therein, the location of the rib and the groove may be reversed. In particular, in this embodiment the rib 46*a* projects radially outwardly from the neck 18*a* of the container 12*a* and is received into a corresponding groove 48*a* in the inner peripheral surface of the skirt 26*a* for vertical retention of the closure 10*a*. It will be understood that this embodiment works much the same way as the first embodiment but in this case the cam surface 52*a* is located on the bottom edge of the skirt.

Figure 12:
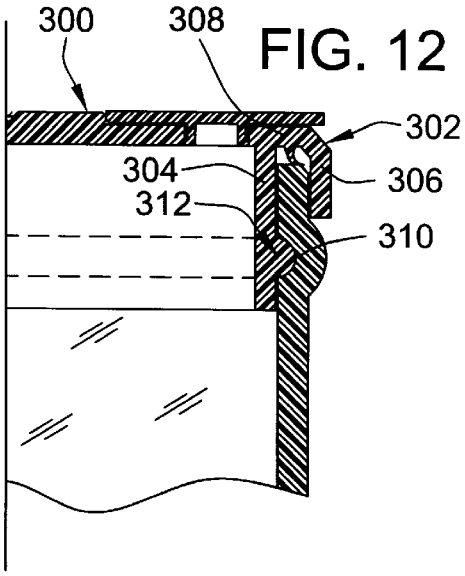

Turning to yet another alternative embodiment illustrated in FIG. 12, it will also be appreciated that the snap fit connection between the closure and the container does not need to be provided along the outer periphery of the neck section and the inner periphery of the skirt. In this embodiment, a closure 300 is provided in which the skirt 302 includes an inner and outer cylindrical flanges 304, 306 joined by an interconnecting top section 308 of the skirt. The inner flange 304 may be longer than the outer flange 306. In this embodiment, the outer periphery of the inner flange 304 includes a recess structure in the form of a groove 310 that receives a projection in the form of a radially outward projecting rib 312 on the outer periphery of the inner flange 304.

Figure 13:
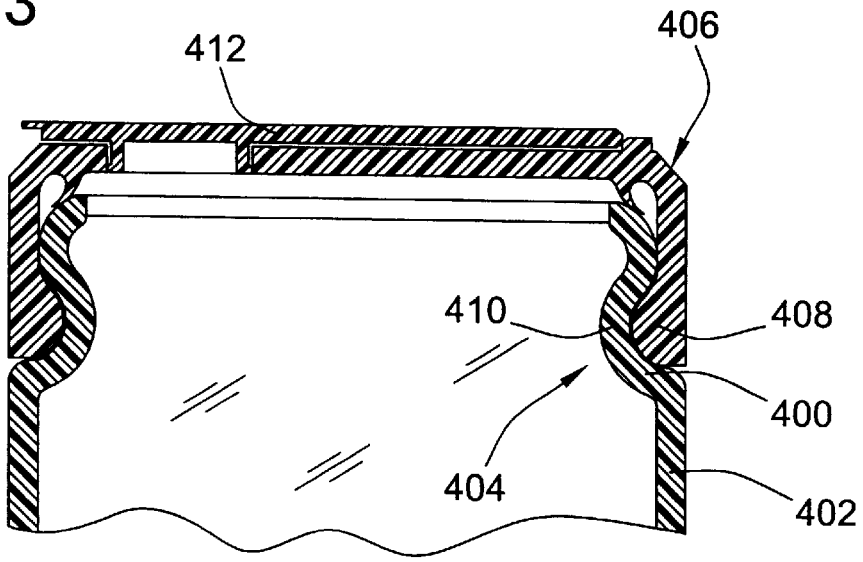

Yet a further embodiment of the present invention is shown in FIG. 13 in which the neck section 400 of the container 402 is illustrated as a smooth curve 404 having a circular cross section. Although not perfectly cylindrical, the neck section 400 performs the same function in the same way as those of the previous embodiments to achieve a snap-on connection and includes a similar projection or recess structure. The server lid or closure 406 snaps on to this container 402 in a similar manner to the previous embodiments with an interfitting rib 408 and groove 410. This embodiment also illustrates the fact that only one hinged flap 412 need be provided on the closure 406.

In any of the embodiments, the snapping structures of the rib 46 and the groove 48 provide an assembly of the closure 10 on the container 12 that achieves retention of the closure 10 without requiring the application of torque to the closure 24 and the resulting deflections or shifts in the plastic material caused by over-torquing. It is a significant advantage that this better prevents the flaps 34, 35 from popping open or coming unsnapped during assembly. According to the preferred method of assembly and referring to FIG. 1, the closure 10 is initially aligned with the neck 18 of the container about a common central axis 50. Then an axial pressing force is applied along the central axis 50 to either press the closure 10 on the container 12 or alternatively press the container 12 on the closure 10. In either event, the action first starts with the rib 46 engaging the sealing lip 20 such that the skirt 26 bends or deflects radially outward from the axis 50 to an increased diameter and the neck 18 bends radially inward towards the axis 50 to a decreased diameter if the container is also plastic and resiliently yieldable (In the case of a glass container or container of non-yielding material, the neck 18 would not bend and remain rigid). In either event, enough clearance is provided to allow the rib 46 to axially slide along the outer cylindrical surface of the neck 18 to allow the rib to reach the groove 48. Once the rib 46 reaches the groove 48, the resilient nature of the plastic material in the closure 10 and the container 12 causes the rib 46 to snap into the groove 48, with the skirt 26 bending radially inwardly towards its original relaxed position and at the same time the neck 18 bending radially outwardly towards its original relaxed position. Once this occurs the upper surfaces of the rib 46 and the groove 48 engage one another to vertically retain the closure 10 on the container 12. In the preferred embodiment, the snap-on connection is substantially permanent in that it is not intended to be removed by the customer without extraordinary force. However, it will be appreciated that such a force could be accomplished by prying the closure off of the container with a tool such as a screwdriver or kitchen utensil, but in doing so the force would also typically mark or otherwise damage the container and/or the closure. This ensures that the closure 10 is reliably retained on the container 12, and does not fall off when shaking spice or other condiment from the container. Although all of the embodiments illustrated in the drawings are considered substantially permanent, it will be appreciated that the level of permanency can be varied. For example, the embodiments of FIGS. 9 and 11 with squared comers or an upwardly angled snap fit connection can be even more permanent than the hemispherical rib and groove approach shown in the preferred embodiment of FIGS. 1–8, thereby increasing the force necessary to remove the lid. The hemispherical shape of the interfitting rib and groove of the preferred embodiment however has the benefit of providing for easier assembly as the smooth curved surfaces act as a cam to direct the outward flaring of the skirt during assembly. It will also be appreciated that a non-permanent snap fit connection could be provided in a less preferred embodiment, and as such certain claims appended hereto are directed towards that possibility.

If the snap-on connection is substantially permanent, it is not desirable to use a plastic or foil sealing strip over the container opening 22. The reason is that the sealing strip would not be easily removed and customers would have to puncture the sealing strip instead. Because a sealing strip is not desirable, it is a further aspect of the present invention that two seal areas are provided. Specifically a seal is provided for each of the dispensing port to prevent air transfer through the dispensing ports and a seal is provided to prevent air transfer between the closure 12 and the neck 18 of the container 12. As indicated above, the plugs 38, 39 form interference fits with their respective dispensing holes 30, 31 to seal off air passageways through the closure 10. The other seal is provided between the closure and the container for both freshness and to prevent material from exiting therebetween. Referring to FIG. 2 a resilient seal 56 in the form of a crush rib is provided between the container 12 and the closure 10 to prevent air passage therebetween. The seal 56 comprises a thin resilient annular web 58 that is sized such that it engages the sealing lip 20 of the container 12 in a biased state such that the sealing surface 60 of the web 58 is biased against the sealing lip 20 to provide a seal once the closure 10 is snapped on the container 12. The amount of deflection in the web 58 from the relaxed to the biased state can be seen comparing FIGS. 1 and 2. The resiliency, thickness, and shape of the web 58 are such that the seal is continuous around the neck of the container.

Figure 8A:
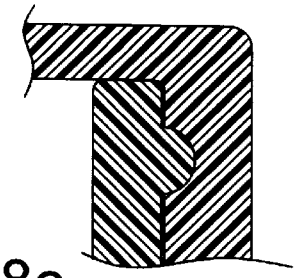
FIGS. 8*a*–8*j* are enlarged fragmentary cross sectional views of alternative embodiments of closures and container necks demonstrating various seals that may be used in the present invention.
Figure 8B:
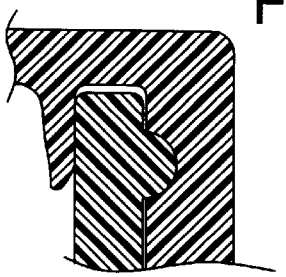
Figure 8C:
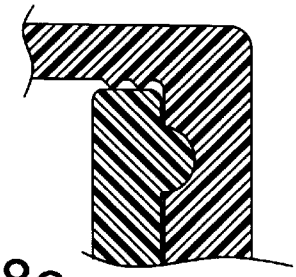
Figure 8D:
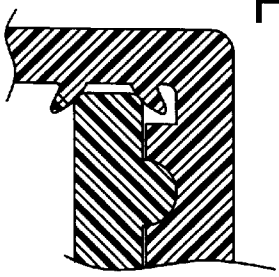
Figure 8E:
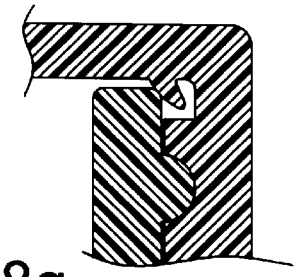
Figure 8F:
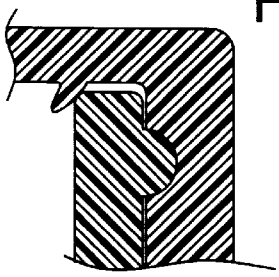
Figure 8G:
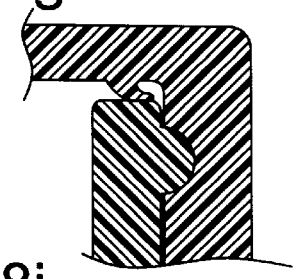
Figure 8H:
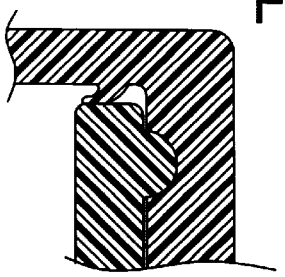
Figure 8I:
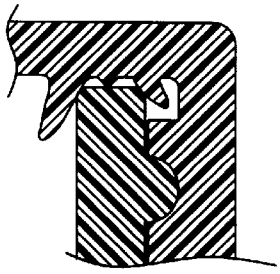
Figure 8J:
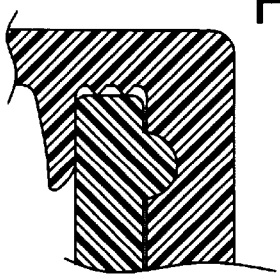

Although one type of resilient seal 56 is illustrated in the preferred embodiment, several other forms of seals may also be used which comprises thin resilient webs of plastic material. Examples of alternative embodiments of such seals are illustrated in FIGS. 8*a*–8*j*. The seals of these alternative embodiments also are ring shaped and engage the sealing lip 20 or alternatively the side walls of the neck of the container all the way around the open end. These alternative embodiments of seals operate substantially the same as those previously discussed in that the resilient nature of the material in that the seal and ultimate location of the seal by virtue of the snap fit connection maintains the seal in a biased state. For example, in FIG. 8*a*, the seal is provided by a tight fitting contact between the sealing lip of the container and the bottom surface of the closure. In FIG. 8*b*, the resilient seal takes the form of a wiper seal or radial seal which is biased radially outward against the inner peripheral surface of the container neck section. FIG. 8*c* illustrates a pair of small projecting ring seals which compress against the sealing lip of the container. FIGS. 8*d*–8*f* illustrate an embodiment where the seal engages the corner of the sealing lip. FIGS. 8*g* and 8*h* illustrate axial crush seals similar to the first embodiment of FIG. 2. FIGS. 8*i* and 8*j* illustrate combinations of the previous seals.

Also, although not shown in the drawings, a plastic shrink wrap over cap may also be used to cover the entire closure 10. Such an over cap would be anchored to the container either just below the bottom edge of the skirt or below the outward projecting bead of the neck.

The foregoing description of various preferred embodiments of the invention has been presented for purposes of illustration and description. It is not intended to be exhaustive or to limit the invention the precise forms disclosed. Obvious modifications or variations are possible in light of the above teachings. The embodiments discussed were chosen and described to provide the best illustration of the principles of the invention and its practical application thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A product dispenser for dispensing particulate material, comprising:

a container having a circular opening at the top of a circular neck section;

a round closure over the opening molded of resiliently yieldable plastic, the closure including a generally horizontal platform formed with a vertically extending dispensing port, a closure flap integrally connected to the platform through a hinge, the hinge supporting the flap to swing upwardly and downwardly between open and closed positions relative to the dispensing port, the platform and closure flap including cooperating snap connectors configured to releasably snap together to hold the closure flap in the closed position, and a generally cylindrical skirt depending downwardly from the platform and at least partially surrounding a portion of the neck section of the container; and a non-threaded snap-on connection retaining the closure on the container, the snap-on connection including an interfitting projection and recess structure which is engaged as the closure is pressed over the circular neck section, the projection and recess being positioned such that they interfit as the closure is pressed over the neck to lock the closure to the container in a substantially non-removable manner.

2. The product dispenser of claim 1 further comprising an annular resilient seal arranged between the neck section and the closure, the annular resilient seal maintained in a biased state by virtue of the locked relationship between the interfitting projection and recess structure.

3. The product dispenser of claim 2 in which the projection and recess are positioned such that in the locked position the underside of the platform is located closely adjacent the rim of the circular opening and wherein the annular resilient seal includes a crush rib interposed between the underside of the platform and the rim, and positioned to create a seal between said underside and said rim when the projection and recess structure reaches its locked condition.

4. The product dispenser of claim 2 wherein the annular resilient seal is a wiper seal depending from the closure forming a radial seal against the circular sides of the neck section.

5. The product dispenser of claim 1 further comprising a plug integrally formed and arranged on the flap such that the plug projects into the dispensing port when the flap is in the closed position, the plug forming a seal against the wall of the dispensing port when the flap is in the closed position.

6. The product dispenser of claim 5 wherein the plug includes a sealing rib projecting horizontally outward from the surface of the plug and surrounding the plug, the sealing rib engaging the platform to provide the seal.

7. The product dispenser of claim 1 wherein the interfitting projection and recess structure include a groove and a rib, both the groove and the rib following coinciding non-helical circular paths.

8. The product dispenser of claim 1 wherein the interfitting projection and recess structure are discontinuous.

9. The product dispenser of claim 1 wherein the interfitting projection and recess structure are located on the outer periphery of the neck section and the inner periphery of the skirt.

10. The product dispenser of claim 1 wherein the skirt includes inner and outer cylindrical flanges separated by a groove, the neck section of the container being received into the groove, the interfitting projection and recess structure being located on the inner periphery of the neck section and the outer periphery of the inner cylindrical flange.

11. The product dispenser of claim 1 wherein the projection and recess are integrally formed with the container and the round closure.

12. The product dispenser of claim 1 wherein the round closure is free of screw threads for connection with the container.

13. A round closure molded of resiliently yieldable plastic for closing an open end of a container, the open end being provided by a circular neck of the container terminating in a circular rim, the neck including a non-helical locking structure, said closure comprising:

a generally horizontally circular platform formed with a vertically extending dispensing port;

a closure flap integrally connected to the platform through a hinge, the hinge supporting the flap to swing upwardly and downwardly between open and closed positions relative to the dispensing port, the platform and closure flap including cooperating snap connectors that are adapted to releasably snap together to hold the closure flap in the closed position;

a cylindrical skirt depending downwardly from the platform and formed integral therewith, the skirt having portion with an inner peripheral surface dimensioned large enough to at least partially surround a portion of the neck of the container; and a non-helical locking structure on the skirt configured to vertically snap past the corresponding locking structure on the neck when the closure is vertically press fit onto the neck of the container, the locking structure being positioned and arranged such that a locked condition secures the closure in a substantially non-removable manner.

14. The product dispenser of claim 13 further a thin resilient annular web of plastic material depending from the closure arranged to be displaced to a biased state for forming a seal against the neck of the container by virtue of the position of the locking structures when interfitted in locked relationship.

15. The round closure of claim 14 further comprising one or more plugs integrally formed and arranged on the flap such that the plugs project into the holes when the associated flap is in the closed position, the plugs forming seals against the walls of the holes when the flap is in the closed position.

16. The round closure of claim 13 wherein the platform includes a plurality of dispensing ports selectively sized and spaced apart to form at least two from the group consisting of a spooning hole, a pouring hole, and sifting holes, the closure comprising at least two separately hinged flaps to cover the respective holes.

17. The round closure of claim 16 wherein the plugs each include a sealing rib projecting horizontally outward from the surface of the plug and surrounding the plug, the sealing rib engaging the platform to provide the seal.

18. The product dispenser of claim 13 wherein the round closure is free of screw threads for connection with the container.

19. A product dispenser for dispensing particulate material, comprising:

a container having a circular opening at the top of a circular neck section;

a round closure over the opening molded of resiliently yieldable plastic, the closure including a generally horizontal platform formed with a vertically extending dispensing port, a closure flap integrally connected to the platform through a hinge, the hinge supporting the flap to swing upwardly and downwardly between open and closed positions relative to the dispensing port, the platform and closure flap including cooperating snap connectors configured to releasably snap together to hold the closure flap in the closed position, and a generally cylindrical skirt depending downwardly from the platform and at least partially surrounding a portion of the neck section of the container; and a non-threaded snap-on connection retaining the closure on the container, the snap-on connection including interfitting snapping structures on the skirt and the neck section with the snapping structures engaging each other for vertical retention.

20. The product dispenser of claim 19 further comprising an annular resilient seal arranged between the neck section and the closure, the annular resilient seal maintained in a biased state by virtue of the locked relationship between the interfitting projection and recess structure.

21. The product dispenser of claim 20 further comprising a plug integrally formed and arranged on the flap such that the plug projects into the dispensing port when the flap is in the closed position, the plug forming a seal against the wall of the dispensing port when the flap is in the closed position.

22. The round closure of claim 21 wherein the platform includes a plurality of dispensing ports selectively sized and spaced apart to form at least two from the group consisting of a spooning hole, a pouring hole, and sifting holes, the closure comprising at least two separately hinged flaps to cover the respective holes.

23. The product dispenser of claim 19, wherein the interfitting snapping structures are integral with each of the container and the round closure.

24. The product dispenser of claim 19 wherein the round closure is free of screw threads for connection with the container.

25. A round closure molded of resiliently yieldable plastic for closing an open end of a container, the open end being provided by a circular neck of the container terminating in a circular rim, the neck including a non-helical snapping structure following a circular path, said closure comprising:

a generally horizontally circular platform formed with a vertically extending dispensing port;

a closure flap integrally connected to the platform through a hinge, the hinge supporting the flap to swing upwardly and downwardly between open and closed positions relative to the dispensing port, the platform and closure flap including cooperating snap connectors that are adapted to releasably snap together to hold the closure flap in the closed position;

a cylindrical skirt depending downwardly from the platform and formed integral therewith, the skirt having a portion with an inner peripheral surface dimensioned large enough to at least partially surround the neck of the container; and a non-helical snapping structure on the skirt following a circular path configured to vertically snap past the corresponding locking structure on the neck such that the snapping structures of the closure and container interlock when the closure is vertically press fit onto the neck of the container for vertical retention of the closure on the container.

26. The product dispenser of claim 25 further a thin resilient annular web of plastic material depending from the closure arranged to be displaced to a biased state for forming a seal against the neck of the container by virtue of the position of the locking structures when interfitted in locked relationship.

27. The product dispenser of claim 25 further comprising a plug integrally formed and arranged on the flap such that the plug projects into the dispensing port when the flap is in the closed position, the plug forming a seal against the wall of the dispensing port when the flap is in the closed position.

28. The product dispenser of claim 25 wherein the round closure is free of screw threads for connection with the container.

* * * * *

UNITED STATES PATENT AND TRADEMARK OFFICE

CERTIFICATE OF CORRECTION

PATENT NO. : 6,299,033 B1
DATED : October 9, 2001
INVENTOR(S) : VerWeyst et al.

It is certified that error appears in the above-identified patent and that said Letters Patent is hereby corrected as shown below:

Title page,
Item [75], the second inventor is listed as "Alfred I. Gray" and should be listed as -- Alfred L. Gray --.

Signed and Sealed this

Sixteenth Day of April, 2002

*Attest:*

*Attesting Officer*

JAMES E. ROGAN
*Director of the United States Patent and Trademark Office*